US005595429A

United States Patent [19]

Kennedy

[11] Patent Number: 5,595,429

[45] Date of Patent: Jan. 21, 1997

[54] COMBINATION COOLER-SEAT-STORAGE TRANSPORTING DEVICE

[75] Inventor: Thomas A. Kennedy, Raritan Township, Hunterdon County, N.J.

[73] Assignee: T.A.K. Enterprises, Inc., Flemington, N.J.

[21] Appl. No.: 419,828

[22] Filed: Apr. 11, 1995

Related U.S. Application Data

[63] Continuation-in-part of Ser. No. 227,068, Apr. 13, 1994, Pat. No. 5,435,643, which is a continuation-in-part of Ser. No. 213,151, Mar. 14, 1994, Pat. No. 5,435,642.

[51] Int. Cl.[6] ..... A47B 83/02; A47B 3/14

[52] U.S. Cl. ..... 312/235.2; 297/188.11; 297/188.13

[58] Field of Search ..... 312/235.1–235.7, 312/236, 241, 270.1, 270.3; 297/192, 193, 217, 188.08, 188.11, 188.13, 344.26, 188.1; 206/315.11

[56] References Cited

U.S. PATENT DOCUMENTS

| | | | |
|---|---|---|---|
| D. 256,630 | 9/1980 | Maney | D7/605 |
| 520,284 | 5/1894 | Wonson et al. | 297/188.13 X |
| 780,933 | 1/1905 | Brown | 297/344.18 X |
| 1,356,558 | 10/1920 | Purcell | 297/344.12 X |
| 2,264,744 | 12/1941 | Dunnam | 297/188.13 |
| 2,812,227 | 11/1957 | Hill | 312/235.2 X |
| 3,213,467 | 10/1965 | Hubbard | 312/235.2 X |
| 3,230,006 | 1/1966 | Sokolis | 312/235.2 X |
| 3,310,905 | 3/1967 | Davis et al. | 206/315.11 X |
| 4,210,363 | 7/1980 | Taipalus | 297/192 |
| 4,248,476 | 2/1981 | Phelps | 297/188.11 X |
| 4,291,915 | 9/1981 | Cox | 297/188.1 X |
| 4,353,182 | 10/1982 | Junkas et al. | 312/235.5 X |
| 4,474,407 | 10/1984 | Nazar | 297/192 |
| 4,556,250 | 12/1985 | Chapman et al. | 312/235.5 X |
| 4,682,813 | 7/1987 | Fohr et al. | 297/344.21 X |
| 4,773,709 | 9/1988 | Slinkard | 297/193 |
| 4,775,187 | 10/1988 | Herr | 297/193 |
| 4,799,731 | 1/1989 | Brown | 297/188.13 X |
| 4,854,261 | 8/1989 | Goldsmith | 312/235.2 X |
| 4,883,317 | 11/1989 | Davenport | 297/188.1 |
| 5,100,198 | 3/1992 | Baltzell | 312/235.2 |
| 5,209,178 | 5/1993 | Rowe | 297/217 X |
| 5,234,143 | 8/1993 | Mahvi et al. | 224/31 |
| 5,269,157 | 12/1993 | Cimineli et al. | 297/188.1 X |
| 5,364,163 | 11/1994 | Hardison | 297/344.26 X |

OTHER PUBLICATIONS

Coleman of Wichita, Kansas–K–Mart sales brochure/Winter 1993.

Rubbermaid of Akron, Ohio–K–Mart sales brochure/Winter 1993.

Plano Corporation of Plano, Illinois–Field & Stream and Outdoor Life/both Nov. 1993.

Bass Pro of St. Louis, Missouri–Pro Bass Magazine/Fall 1993.

*Primary Examiner*—Peter M. Cuomo
*Assistant Examiner*—Robert J. Sandy
*Attorney, Agent, or Firm*—Kenneth P. Glynn, Esq.

[57] ABSTRACT

The present invention is a combination cooler-seat storage transporting device. It includes a main housing, a cover, drawers, a seat and handles. The main housing has a top, a bottom, sidewalls, and a front, and has an upper section with an open top and with insulation, and has a lower section. There is an open front having a hinged door thereon, the lower section further containing a plurality of horizontal drawer supports therein. The cover is hingedly connected to the main housing at the open top and also has an outer wall with heat insulation. These are a plurality of drawers located within the housing which are slidably connected to the drawer supports located inside said housing behind said door. In one preferred embodiment, the handles are shoulder straps and the device is contoured to a human back. In another embodiment, the main housing is ribbed and some ribs have open tops for storing and/or holding elongated objects, such as rods, arrows, poles, etc.

20 Claims, 6 Drawing Sheets

COMBINATION COOLER-SEAT-STORAGE TRANSPORTING DEVICE

This application is a Continuation-in-Part U.S. patent application Ser. No. 08/227.068, filed on Apr. 13, 1994, now issued as U.S. Pat. No. 5,435,643, and entitled "COMBINED SEAT/SIDE-BY-SIDE COOLER/EQUIPMENT STORAGE DEVICE", which itself is a Continuation-in-Part of U.S. patent application No. 08/213,151, filed Mar. 14, 1994, now issued as U.S. Pat. No. 5,435,642, and entitled "COMBINED COOLER-SEAT SPORTS GEAR BOX."

BACKGROUND OF THE INVENTION

1. Field of the Invention

The present invention is directed to a combination device which acts as a portable storage device, a cooler and a seat. More specifically, the present invention involves such devices as will permit access to various storage areas without removal of other storage areas. The present invention device may be used for sports activities or any other outdoor activities which may require waiting, seating, food storage and possible storage of gear or equipment. It may be in the form of a backpack and may, for example, be used as a fishing tackle box-cooler-seat.

2. Description of the Prior Art

Campers, hunters, fishermen and other people involved in other outdoor activities have used various types of coolers as well as various types of tackle boxes and sports gear boxes. Coleman of Wichita, Kans. manufactures single area coolers and multiple compartment coolers, and Rubbermaid of Akron, Ohio likewise manufactures and sells multiple compartment coolers. However, these all have lids which are hinged at the top horizontally and swing up to open or are removable upwardly to open. A sales brochure from K-mart, from Winter of 1993, illustrates Coleman coolers as well as Rubbermaid coolers, all with open tops. Tackle boxes have been developed by Plano Corporation of Plano, Ill. and these include stowaway tackle boxes with top and front openings as shown on the two pages from Field & Stream and Outdoor Life, both November, 1993.

Some coolers have been adapted to include seats and straps and Bass Pro of St. Louis, Mo., sells padded stools with swivelling seats which include storage bags underneath. Bass Pro also sells cooler stool fanny packs and separately sells rigid, top opening coolers with seats. These are shown on a one page sales brochure from the Fall 1993 issue of Pro Bass Magazine.

U.S. Pat. No. Des. 256,630 issued to T. H. Maney on Sep. 2, 1980 illustrates an ornamental design for a knapsack cooler.

U.S. Pat. No. 780,933 issued to W. T. Brown on Jan. 24, 1905 describes an extension piano stool in which the seatboard may be readily adjusted according to the altitude required to accommodate the occupant.

U.S. Pat. No. 1,356,558 issued to J. Purcell on Oct. 26, 1920 describes a locomotive cab seat in which the seat swings forward to open a storage box situated underneath the seat.

U.S. Pat. No. 2,264,744 issued to R. A. Dunnam on Dec. 2, 1941 teaches a combined tackle box and seat which provides a container for fishing tackle, food and the like and may be quickly and easily converted into a comfortable seat and easily be transported from place to place.

U.S. Pat. No. 2,812,227 issued to A. Hill on Nov. 5, 1957 teaches a combined hassock and bar in which dual seats swing upwardly left and right to open a double level bar with glasses and bottles.

U.S. Pat. No. 3,230,006 issued to A. Sokolis on Jan. 18, 1966 teaches a fisherman's chair, and more particularly, a chair that is foldable and is attached to a box-like receptacle.

U.S. Pat. No. 3,310,905 issued to R. E. Davis et al. on Mar. 28, 1967 describes a fishing tackle box which unfolds and contains separate compartments with drawers for fishing tackle or other storage.

U.S. Pat. No. 4,248,476 issued to M. B. Phelps on Feb. 3, 1981 relates to a convertible seat assembly device which has a lower drawer storage compartment and is convertible into two back-to-back seats. The seat is comprised of a lower box-shaped base member and has a sliding drawer storage area therein; the base member has a horizontal cushioned top and a cushioned back member which extends vertically therefrom. The cushioned back member has a cushioned front and back face with the back face connected to the front face by a hinge member along the top edge of each face member. When not in use, the second seat member and its support means are folded behind the back face member and are secured to the base member along a rod extending along the top back edge of the base. In order to use the second seat, the back face is swung up along its hinge so that the second seat member can be lowered to a horizontal position and its support member swung out to a downward vertical position along the front edge of the second seat member. There is access to the storage drawer when one or both seats are in use; and the device occupies only the floor space under the base member when only one seat is in use.

U.S. Pat. No. 4,210,363 issued to Larry R. Taipalus on Jul. 1, 1980 describes an elongated stiff tubular body of preferably heat-insulating material, such as cardboard, which has a flexible plastic cover that is held in place at its upper end between a pair of discs interconnected by fasteners. The upper disc forms the base of a cushion of flexible padding within a flexible plastic cover. The plastic cover of the body is reversely bent around the lower end thereof and is clamped within the interior thereof by a tubular clamping member which also holds in place the upwardly-bent peripheral portion of a flexible closure of sheet material equipped with an arcuate opening closed by a circular side fastener. A grooved base ring encircles the lower end of the body and its cover. Also held in place between the lower disc at the top of the body and the tubular clamping member at its lower end is a hollow cylindrical coating or wall of heat-insulating material, such as foam plastic. A carrying strap is secured to the body near its opposite ends for placing over the usual shoulder. A hollow cylindrical lining of heat insulating material, such as foam plastic, is secured within the body.

U.S. Pat. No. 4,353,182 issued to Ronald J. Junkas on Oct. 12, 1982 describes a fishing box which incorporates the following built-in features: tackle box, seat, life preserver, fishing rod carrier, cooler, worm and minnow bait compartment, fish compartment, lid-table tray, a flip-out side table, a ruler for measuring the lengths of fish, a fish net holder, towel rack, and an accessory attachment for supporting an accessory such as a portable radio.

U.S. Pat. No. 4,474,407 issued to Robert C. Nazar on Oct. 2, 1984 relates to an ingenious portable foldable chair, constructed of molded plastic or the like, provided with a seat which has therein a hollow thermally insulated compartment. The compartment may be lined and may be provided with a locking seat compartment access panel or door which provides sealing of the compartment and access to perishable foodstuffs, canned or bottle beverages, ice, fishing bait, or the like.

U.S. Pat. No. 4,556,250 issued to Athol W. Chapman on Dec. 3, 1985 describes an article holder for stadium type chairs which includes a support member that is positioned and held underneath the seat portion of a stadium type chair by a holding sock which slips over the seat portion. A shelf is slidably attached to the support member and slides between an extended position wherein a portion of the shelf extends beyond the front edge of the seat portion of the chair and a retracted position wherein the shelf is totally underneath the seat portion. During an event wherein the stadium type chair is occupied, if the occupant of the chair has purchased a beverage, hot dog or the like and wishes to place them somewhere without fear of their being spoiled, kicked or staining the occupant's clothing and the like, the shelf is simply moved from the retracted to the extended position and the beverage, hot dog or other article is placed thereon without fear of spillage or the like. After termination of the event the article holder is simply slipped off of the chair for easy transport by the occupant out of the stadium.

U.S. Pat. No. 4,682,813 issued to Robert D. Fohr, et al. on Jul. 28, 1987 relates to a tackle container assembly mountable below a deck-mounted pedestal seat, which includes an upper principal member secured to the lower surface of the seat and means depending therefrom to support one or more containers in positions spaced well above the deck, such that fishing tackle can be readily accessible to a fisherman without interfering with or limiting the position of his feet beneath the seat of his hands and arms during fishing movements. Preferred embodiments include a slotted arrangement and/or spacers to allow good utilization of as much space beneath the pedestal seat.

U.S. Pat. No. 4,773,709 issued to Ronald L. Slinkard on Sep. 27, 1988 describes a boat seat which also functions as an insulated container and a framework for mounting same in a boat. The boat seat/insulated container combination comprises a generally cylindrical insulated sidewall with a top on which a person will be seated and a bottom which fits into a mounting receptacle. A portion of the sidewall is extended above the top to form a back for the seat and contains an opening near its top edge to provide a handle for carrying the seat. The mounting arrangement comprises a central set of parallel tubular members onto which is pivotally mounted a base plate and receptacle for receiving the seat. Telescopically attached to each end of the central mounting unit is a set of L-shaped parallel tubular members, the two sets being adjustable with each other to fit the width of the bottom of the boat. Telescopically attached to each L-shaped member is a set of U-shaped parallel tubular members, the fitting of which is adjustable to fit the height of the sidewall of the boat. An alternative embodiment provides a mounting arrangement adapted to fit a box type boat seat. The alternative mounting comprises a central set of parallel tubular members similar to those of the preferred embodiment. Telescopically attached to each end of the central members is a set of L-shaped parallel tubular members. The horizontal legs of the L-shaped members are adjusted with the central members to fit the width of the box type boat seat. The vertical legs of the L-shaped members extend downwardly and fit tightly against the sides of the boat seat by means of bolt and pressure plate assemblies. Thus, a pivotal boat seat/insulated container is provided which can be adapted to fit varying sizes and styles of boats, either without seats or with box type seats.

U.S. Pat. No. 4,775,187 issued to Richard W. Herr on Oct. 4, 1988 describes a folding boat chair formed by a molded plastic seat member and a molded plastic back member. An integral boss on the underside of the seat member presents a socket which fits on the top end of an upright post mounted in the boat. The seat can turn on the post and can be locked in place by a clamp mechanism. Pins which are integral with the sides of the back member fit in passages in sides of the seat member to pivotally connect the members without the need for separate hinge components.

U.S. Pat. No. 4,854,261 issued to Howard G. Goldsmith on Aug. 8, 1989 describes a combination seat for boats which includes a housing comprising lower and upper housing sections and a galley assembly mounted in the lower housing section, the galley assembly including a sink, a water supply tank, a water dispenser pump and a thermally insulated container member. The seating assembly is adapted to be moved between an erected position wherein it defines a pair of back-to-back seats and a collapsed position wherein it defines a substantially flat sleeping platform, and the upper housing section and the seating assembly are upwardly hingeable to provide access to the galley assembly.

U.S. Pat. No. 5,100,198 issued to Ricky L. Baltzell on Mar. 31, 1992 describes a seat cooler apparatus which includes a cushion seat member removably mounted relative to an underlying cabinet, wherein the cabinet includes a cooler chest defined by an extensible and retractable drawer, and further including retractable wheels mounted to sidewalls of each cabinet for portability of the organization.

U.S. Pat. No. 5,209,178 issued to Jerry D. Rowe on May 11, 1993 relates to a fishing boat that has a flat inner floor with a front operating system which has a seat moveable between a lower run position and a raised fishing position. A base frame includes abutting box-like members having a common wall. The frame is secured to the floor with a base plate secured to the first forward box-like portion. The rearward frame box-like portion defines a recess to receive a cooler having a raised and flat top wall. A non-load bearing hinge unit in the form of arms or a single plate has a length greater than the vertical distance between the base plate and the top wall of the cooler. The hinge unit is secured to the rear edge of the base plate for folding onto the base plate, with the seat abutting the base plate and without any load on the hinge unit. The seat plate is secured to the outer end of the hinge unit and folds onto the base plate in the folded position. In an unfolded position, the hinge unit locates the seat plate in a raised position resting on the top wall of the cooler, without any load on the hinge unit.

U.S. Pat. No. 5,234,143 issued to A. Pascal Mahvi, et al. on Aug. 10, 1993 describes a multipurpose traveling bag for carrying personal items and/or infant care supplies which comprises a primary bag section and a removable auxiliary bag section which is disclosed. The primary bag section can be hand carried or worn as a backpack with or without the removable auxiliary bag section. The primary bag section has a fold down seat that can be used as a booster seat by infants in a first or infant care bag embodiment of the present invention. In a third embodiment, the present invention is adapted to be mounted upon a bicycle to additionally provide an infant bicycle seat. In all three embodiments a cooler compartment provides for the storage of perishable food items. The multipurpose traveling bag is constructed of a vinyl or nylon covered extruded plastic framework or can be fabricated from vacuum formed plastic. It is therefore lightweight and easy to clean.

U.S. Pat. No. 5,364,163 issued to Michael D. Hardison on Nov. 15, 1994 describes a new and improved adjustable leg chair which includes a seat assembly and a leg assembly supporting the seat assembly. The leg assembly includes a seat support member supporting the seat assembly and leg members supporting the seat support member. The leg assembly also includes spike members connected to the leg members. The spike members project from the leg members in a direction opposite of the seat support member. The spike members are capable of penetrating into a sloped ground surface. The leg members may include two vertical portions connected to the seat support member and a transverse member connected between the two vertical portions. The vertical portions and the transverse member are in the form of a unified, integrated U-shaped leg member. The spike members are supported by and project from the transverse members. A swivel assembly is located between the seat assembly and the leg assembly. The swivel assembly supports the seat assembly and the swivel assembly is supported by the leg assembly. Two of the leg members include a telescopic length adjusting assembly capable of adjusting an effective length of the leg members. The leg members include threaded wells for receiving removable and replaceable complementary threaded spike members. Notwithstanding the above-cited prior art, the present invention is neither taught nor rendered obvious thereby.

SUMMARY OF THE INVENTION

The present invention is a combination cooler-seat storage transporting device. It includes a main housing, a cover, drawers, a seat and handles. The main housing has a top, a bottom, sidewalls, and a front, and has an upper section with an open top and with insulation, and has a lower section. There is an open front having a hinged door thereon, the lower section further containing a plurality of horizontal drawer supports therein. The cover is hingedly connected to the main housing at the open top and also has an outer wall with heat insulation. These are a plurality of drawers located within the housing which are slidably connected to the drawer supports located inside said housing behind said door. In one preferred embodiment, the handles are shoulder straps and the device is contoured to a human back. In another embodiment, the main housing is ribbed and some ribs have open tops for storing and/or holding elongated objects, such as rods, arrows, poles, etc.

BRIEF DESCRIPTION OF THE DRAWINGS

The present invention should be more fully understood when the specification herein is taken in conjunction with the drawings appended hereto, wherein.

DETAILED DESCRIPTION OF THE PRESENT INVENTION

Figure 1:
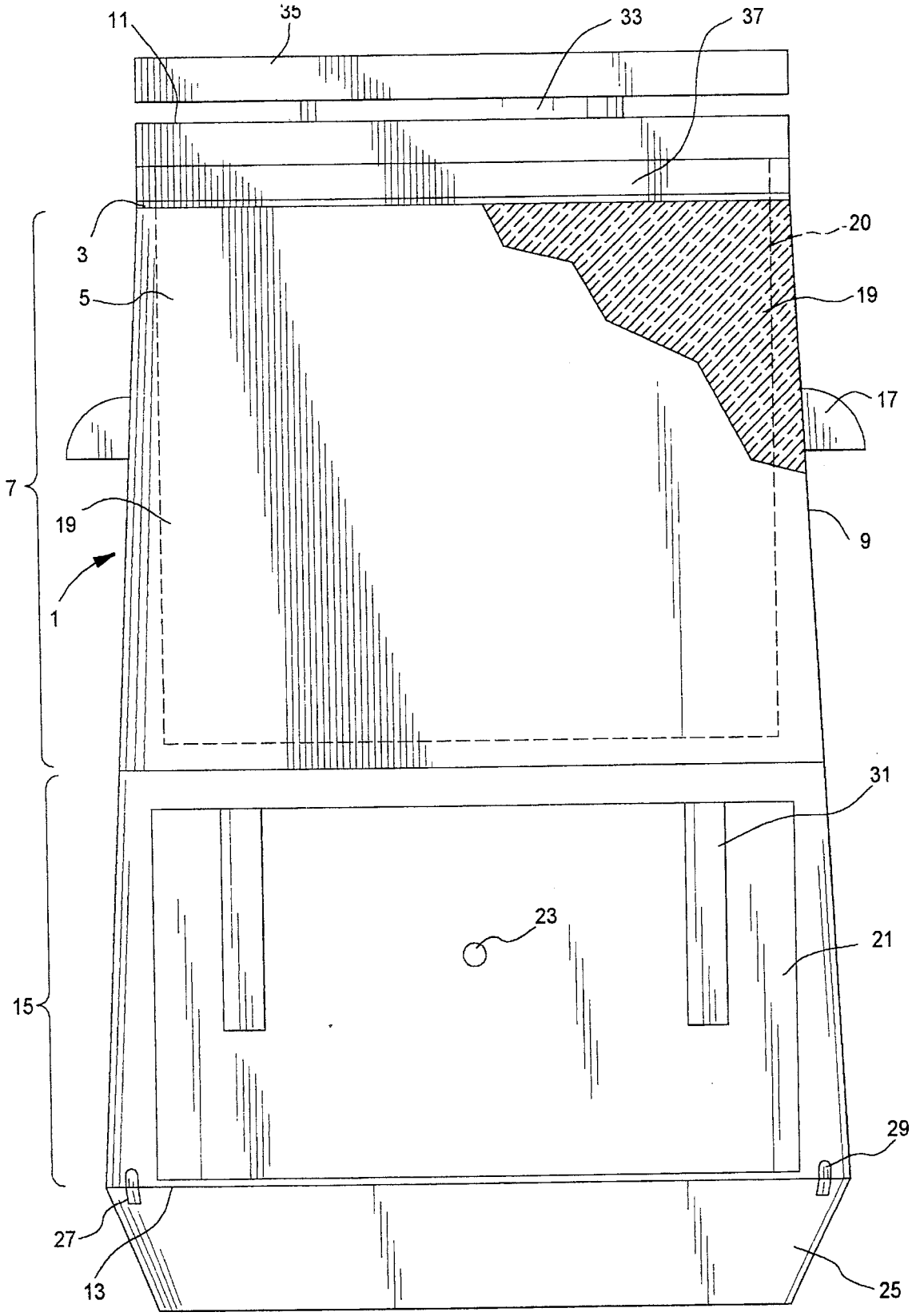
FIG. 1 shows a front view of a present invention device.

Referring now to FIG. 1, there is shown a front view of present invention device 1. Device 1 is a combined cooler-seat-storage and transporting device and may advantageously be used for sports, especially for hunting and fishing, and for other outdoor activities such as camping, outdoor spectator events, local sports games, e.g. high school or little league football, soccer or baseball games, beach going, canoeing, boating, outdoor painting, temporary outdoor stands such as at flea markets, as well as thousands of other uses immediately foreseeable to the artisan once the device is described. The device can be used to provide a seat, while providing separate storage areas for sports gear, ammunition, fishing tackle, lures, camping equipment, etc., and for food which may be kept cool due to the insulative cooler aspects of the present invention.

Device 1 includes a main housing 3 with a front 5 and sidewalls such as sidewall 9 and a back (not shown), as well as a cover 11 and a bottom 13. Main housing 3 has an open top which is covered by cover 11 and has an upper section encompassed by bracket 7 and a lower section encompassed by bracket 15. Upper section 7 has inside walls and outside walls with heat insulation therebetween as illustrated by cut section 19. Open top cooler bin 20 would be contained within upper section 7 and is illustrated by dotted line cooler bin 20. Lower section 15 may or may not be insulated. Main housing 3 has generally rectangular surfaces but is tapered outwardly going from top to bottom so as to be a truncated pyramid. There are handling means, here, such as handle 17 located on sidewall 9. Also, lower section 15 of front 5 has at least one door 21 and, in this embodiment, has a single door 21 with hinges at its bottom (located inside and not shown in FIG. 1) so that it swings downwardly. Door 21 has an opening finger recess 23 and includes inset drop down legs such as leg 31 which are hingedly connected to door 21 and are used to swing out and support door 21 when it is opened to a horizontal position to create a horizontal shelf. Behind door 21 are a plurality of drawer supports with horizontally slidable drawers located therein. There is a subbase 25 which is attached to bottom 13 in a removable fashion, e.g. by suitcase-type latches such as latches 27 and 29. Subbase 25 is hollow and is an optional feature which may be used for additional storage space. At cover 11 is a swivel post 33 and a swivel seat 35.

Figure 2:
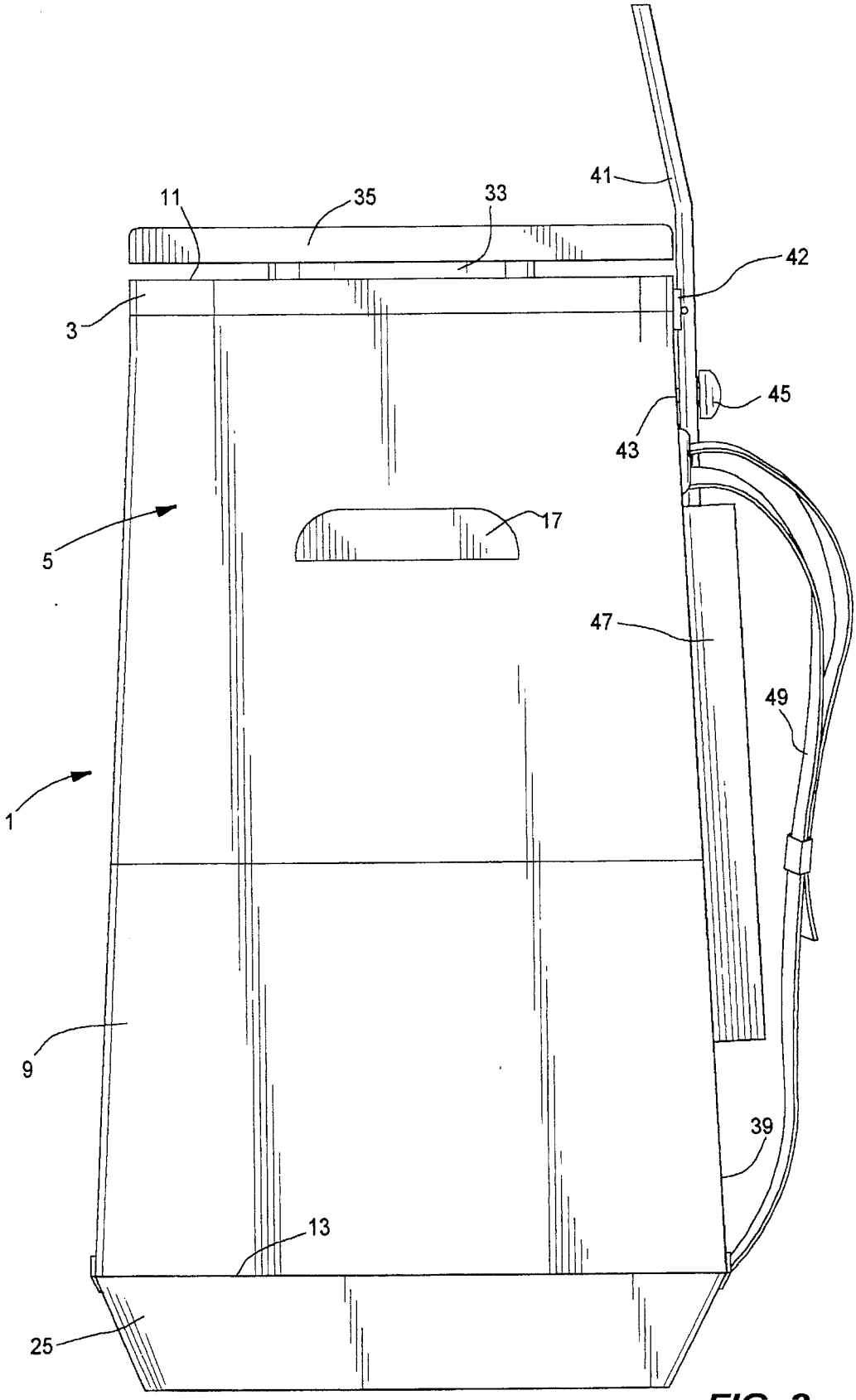
FIG. 2 shows a side view of the device shown in FIG. 1.
Figure 6:
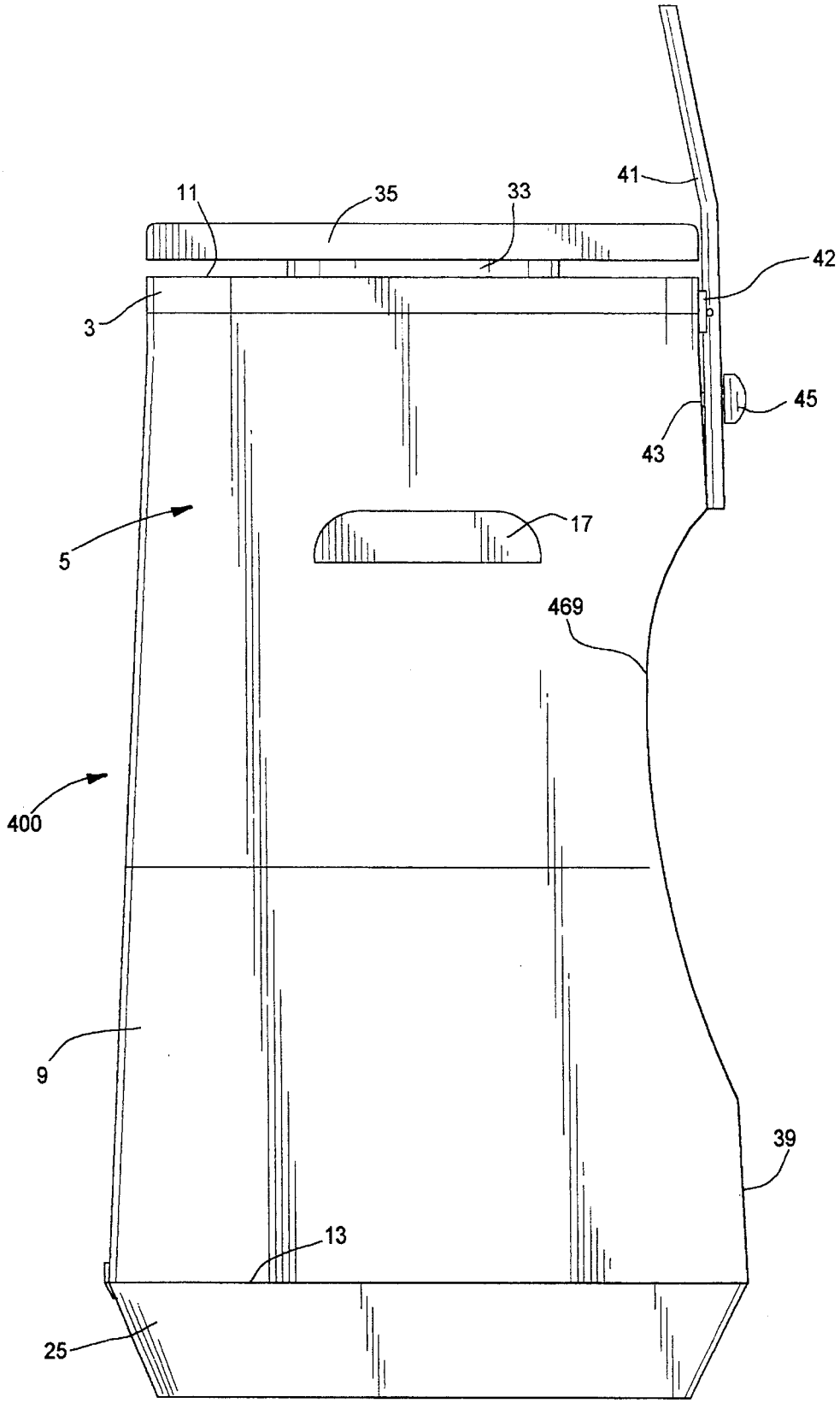
FIG. 6 shows the feature of the contoured back portion.

FIG. 2 shows a side view of device 1 but now including seat back 41. It includes a knob 45 and bolt 43 on back 39 for attachment and removal of seat back 41. Also, pad 47 is included and may be removably attached. Pad 47 is preferably contoured to fit the human back. Alternatively, the back 39 may be contoured (curved) to fit the human back, for example, for those embodiments where there is no pad 47. Referring to FIG. 6, when back 39 is contoured back 469, it is constructed using conventional commercial molding processes and does not effect other sections of the present invention. Alternatively, either pad 47 or a contoured back 469 may be used in place for comfort to the body as when carried in knapsack fashion with straps such as strap 49. Pad 47 removed and used separate from device 1, or against seat back 41, as desired. Also, note that hinge 42 is shown to hingedly connect cover 11 to main housing 3. All other aspects that are shown in FIG. 1 are identically numbered as shown in FIG. 1.

Figure 3:
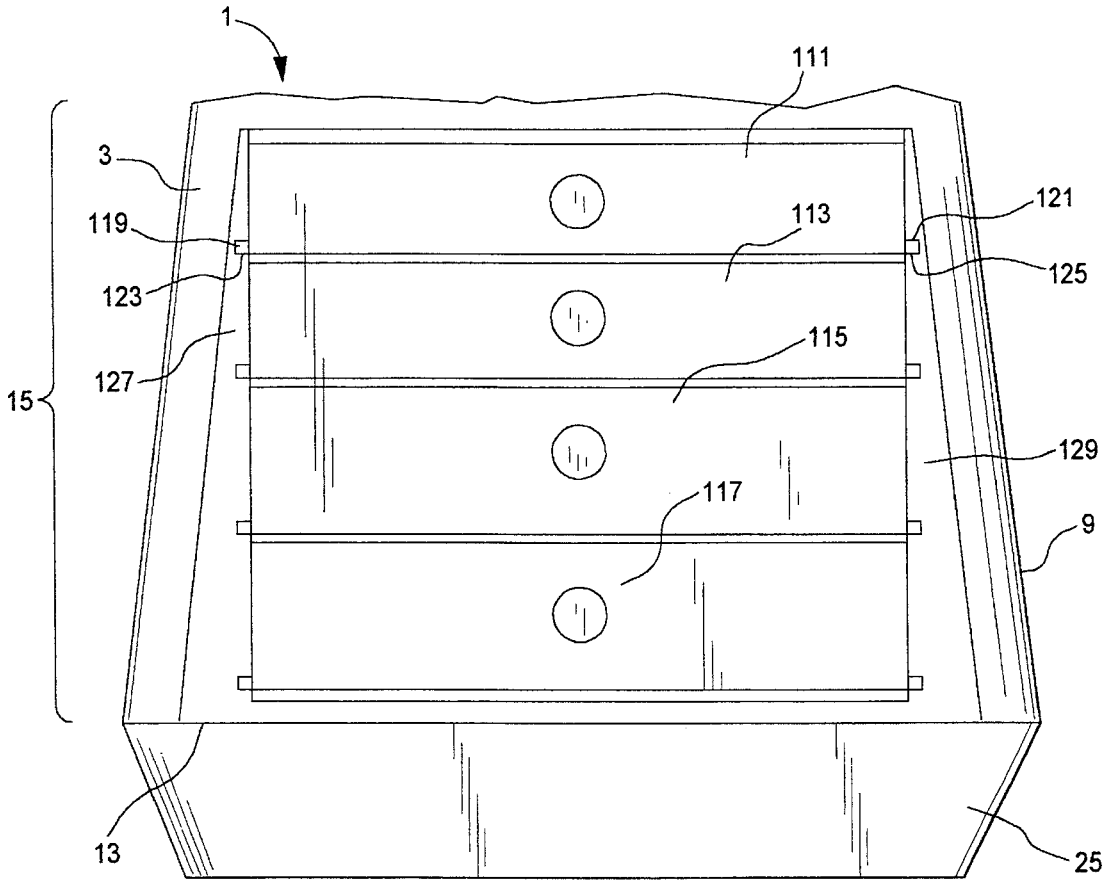
FIG. 3 shows a partial cut front view of the device shown in FIGS. 1 and 2 but with the drawers shown, with the door removed.

FIG. 3 shows a partial cut front view of lower section 15 device 1 with the door 21 removed to show an arrangement of drawers and supports useful in the present invention. Here drawers 111, 113, 115 and 117 are shown, with the top drawers 111 and 113 being smaller in height and drawers 115 and 117 being greater in height. These drawers 111, 113, 115 and 117 have "wings" or flanges such as flanges 119 and 121 (drawer 111) which slide in recesses 123 and 125 of inner walls 127 and 129.

Figure 4:
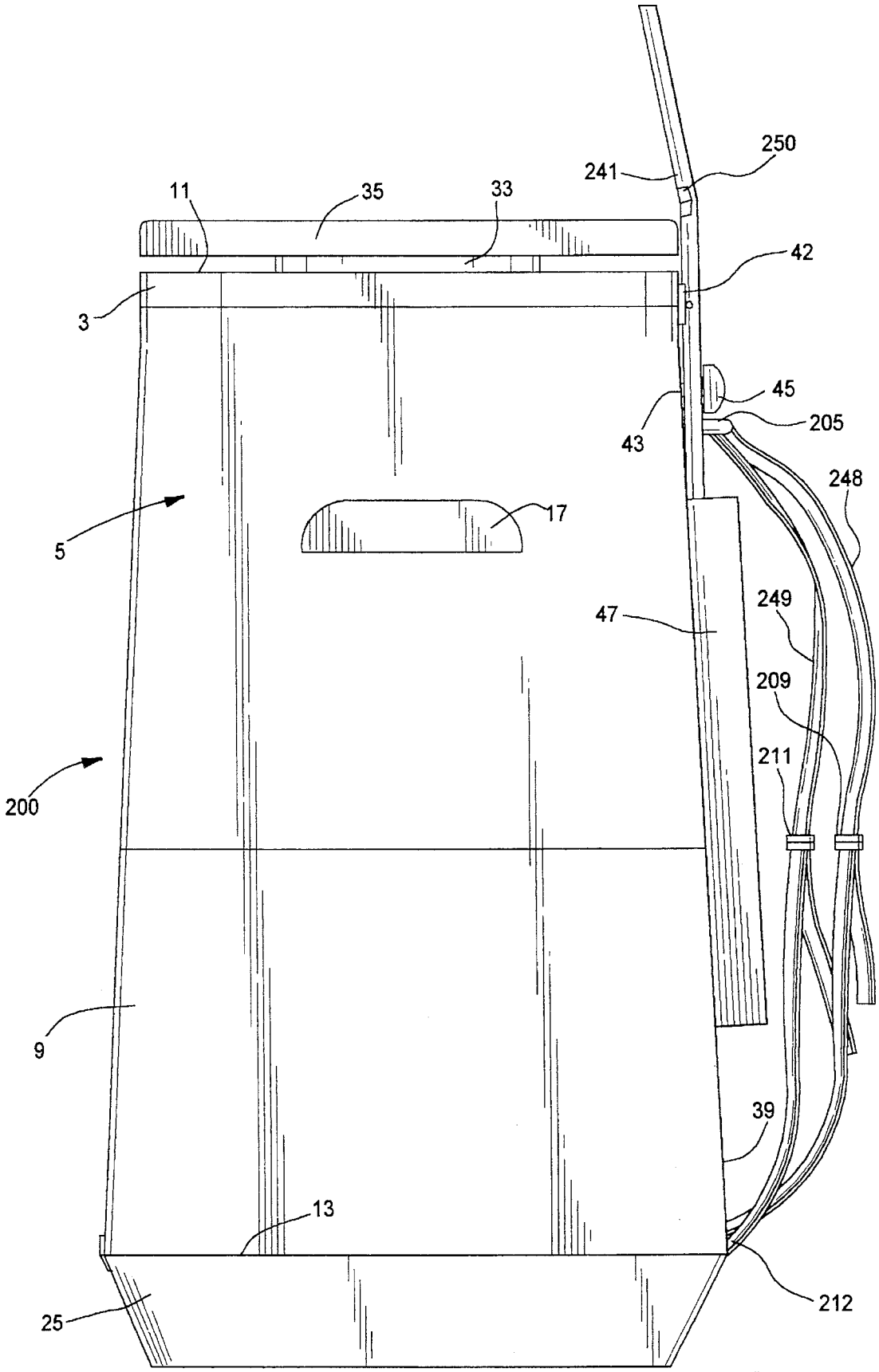
FIG. 4 shows an alternative embodiment of the invention depicted in FIG. 2 with adjustable straps and foldable back support.

Referring to FIG. 4, an alternative embodiment of the present invention device 200 is shown with two adjustable straps 248 and 249 and strap slots 205, 207, strap adjusters 209 and 211 and strap anchors 212, 213. A back pad 47 is also depicted. The straps 248 and 249 are fed into strap slots 205,207 (hidden) and through strap adjusters 209,211 respectively and would be adjustable. The straps 248 and 249 could be connected front to back (front not shown) and be extended by adjustment to be carried over-the-shoulder or be adjusted so as to permit hand carrying of the device 200. In addition, FIG. 4 depicts a foldable seat back 241. Foldable seat back 241 has a conventional hinge type mechanism 250 which allows foldable seat back 241 to be folded down over swivel seat 35.

Figure 5:
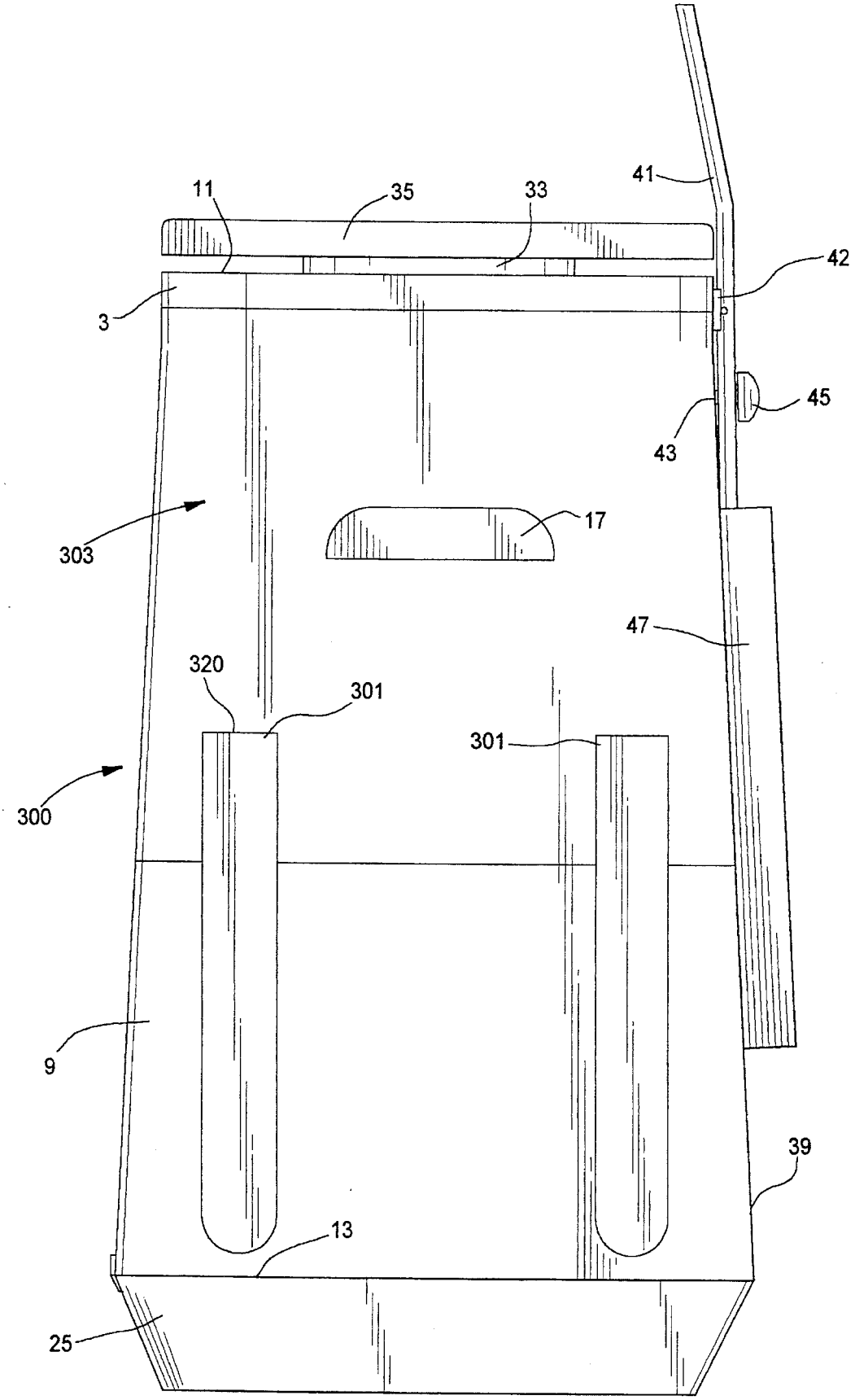
FIG. 5 shows the housing having a rib structure.

Referring now to FIG. 5, an alternative embodiment of the device 300 has a plurality of rib structures 301 which enhance and provide additional structural support. It is known that a rib structure, as more clearly seen in FIG. 7, will provide greater support than a straight section over the same length. Rib structures 301 are an integrated part of housing 303 and run in a substantially vertical manner. In addition, some of the rib structures 301 have openings at a top end 320 to hold elongated objects, such as rods, arrows, poles and other items.

Obviously, numerous modifications and variations of the present invention are possible in light of the above teachings. It is therefore understood that within the scope of the appended claims, the invention may be practiced otherwise than as specifically described herein.

What is claimed is:

1. A combination cooler-seat storage transporting device, which comprises:

a) a main housing having a top, a bottom, sidewalls, and a front, said housing having an upper section and a lower section, said upper section having inner walls and outer walls and having heat insulation therebetween, said housing further including an open top at said upper section, an open front at said lower section, said open front having a hinged door thereon, said lower section further containing a plurality of horizontal drawer supports therein;

b) a cover hingedly connected to said main housing at said open top of said upper section, said cover having an inner wall and an outer wall with heat insulation therebetween;

c) a plurality of drawers located within said housing and slidably connected to said drawer supports for horizontal opening and closing thereof, wherein at least a portion of said plurality of drawers are located inside said housing behind said door;

d) a seat located on said cover of said housing; and, e) handling means on said housing for manually carrying same.

2. The device of claim 1 wherein said main housing is generally rectangular in shape.

3. The device of claim 1 wherein said main housing is tapered inwardly from a portion of its lower section upwardly to enhance stability.

4. The device of claim 1 where said housing further includes a removable sub-base which forms a bin to provide storage space and is removably attached to said main housing bottom.

5. The device of claim 1 wherein said door is hingedly mounted on said housing to swing downwardly to open.

6. The device of claim 5 wherein said door may be opened into a horizontal position to form a horizontal shelf.

7. The device of claim 1 wherein said seat is a swivel seat.

8. The device of claim 1 wherein said seat includes a cushion.

9. The device of claim 1 wherein said seat includes a back support member.

10. The device of claim 9 wherein said back support member is foldable.

11. The device of claim 1 wherein said main housing includes ribs for structural support.

12. The device of claim 11 wherein at least one of said ribs includes an open top to form a holding means with said rib for elongated objects.

13. The device of claim 1 wherein said handling means is two protruding handles located on the sidewalls of said housing.

14. The device of claim 11 wherein said handling means is at least one adjustable strap.

15. The device of claim 14 wherein there are two adjustable straps connected to said housing so as to permit carrying of said device in a knapsack fashion.

16. The device of claim 15 wherein at least one adjustable strap may be adjusted to a hand carrying position to a shoulder strap position.

17. The device of claim 15 wherein said main housing sidewalls includes a back portion which is curved to contour a back of a human.

18. The device of claim 1 wherein said main housing is formed of molded plastic.

19. The device of claim 18 wherein said main housing has a plurality of substantially vertically formed ribs to enhance structural support.

20. The device of claim 19 wherein at least one of said ribs has an upper end.

* * * * *